US009276338B1

(12) United States Patent
Dariavach et al.

(10) Patent No.: US 9,276,338 B1
(45) Date of Patent: Mar. 1, 2016

(54) COMPLIANT PIN, ELECTRICAL ASSEMBLY INCLUDING THE COMPLIANT PIN AND METHOD OF MANUFACTURING THE COMPLIANT PIN

(71) Applicant: EMC Corporation, Hopkinton, MA (US)

(72) Inventors: Nader G. Dariavach, Milford, MA (US); Jin Liang, Southborough, MA (US); Gordon O. Barr, Fall River, MA (US); Paul T. Callahan, Acton, MA (US)

(73) Assignee: EMC Corporation, Hopkinton, MA (US)

( * ) Notice: Subject to any disclaimer, the term of this patent is extended or adjusted under 35 U.S.C. 154(b) by 18 days.

(21) Appl. No.: 14/313,143

(22) Filed: Jun. 24, 2014

(51) Int. Cl.
*H01R 13/42* (2006.01)
*H01R 12/58* (2011.01)

(52) U.S. Cl.
CPC ..... *H01R 12/585* (2013.01)

(58) Field of Classification Search
CPC ..... H01R 12/585
USPC ..... 439/751, 82, 825
See application file for complete search history.

(56) References Cited

U.S. PATENT DOCUMENTS

| | | | | |
|---|---|---|---|---|
| 2,877,441 | A * | 3/1959 | Narozny | H01R 13/052 439/82 |
| 4,676,579 | A | 6/1987 | Ting | |
| 4,769,907 | A | 9/1988 | Sebastien | |
| 6,077,128 | A | 6/2000 | Maag et al. | |
| 6,716,072 | B1 | 4/2004 | Downes | |
| 6,800,545 | B2 | 10/2004 | Downes | |
| 7,344,389 | B2 * | 3/2008 | Kramski | H01R 12/585 439/82 |
| 7,891,992 | B2 * | 2/2011 | Veigel | H01R 9/091 439/82 |
| 8,092,262 | B1 | 1/2012 | Frederick et al. | |
| 2007/0212907 | A1 | 9/2007 | Kramski | |
| 2008/0166928 | A1 | 7/2008 | Tang | |
| 2008/0318453 | A1 | 12/2008 | Dancison | |
| 2011/0159743 | A1 | 6/2011 | Johnescu et al. | |
| 2012/0115339 | A1 | 5/2012 | Schaarschmidt et al. | |
| 2012/0231677 | A1 | 9/2012 | Kallee | |
| 2013/0316551 | A1 | 11/2013 | Day, Jr. et al. | |

OTHER PUBLICATIONS

"Compliant Pin; Engineering Dictionary," http://www.interfacebus.com/glossary-pwb-compliant-pin-description.html, Apr. 2012, 3 pages.

Interplex Industries, Inc., "PCB Hole Construction and Material Requirements for Use with Press-Fit Technologies," Press Fit Tech Bulletin, www.interplex.com, 2011, 2 pages.

* cited by examiner

*Primary Examiner* — Phuong Dinh
(74) *Attorney, Agent, or Firm* — Ryan, Mason & Lewis, LLP

(57) ABSTRACT

A compliant pin comprises a base portion at a proximal end of the compliant pin, a tip portion at a distal end of the compliant pin, and a medial portion between the base portion and the tip portion. The medial portion includes a first arm and a second arm, and the tip portion includes first and second extensions extending from the first and second arms, respectively, the first and second extensions defining a slit therebetween.

20 Claims, 9 Drawing Sheets

COMPLIANT PIN, ELECTRICAL ASSEMBLY INCLUDING THE COMPLIANT PIN AND METHOD OF MANUFACTURING THE COMPLIANT PIN

FIELD

The field relates to electrical contacts, and more particularly to compliant pins.

BACKGROUND

Systems that connect electronic components often use conductive pins and conductive, plated-through holes (PTHs). Typically, a system of this type includes an electronic component having a plurality of metal pins extending therefrom and another component having a corresponding plurality of holes to receive the pins when the two components are aligned with each other. The electronic components can include, for example, printed circuit boards (PCBs) and integrated circuits (ICs).

In order to connect the two components, a housing of the component including the pins and a housing of the component including the holes are brought together to insert the pins into the holes. To form a secure connection between the pins and the holes, a solder-less "compliant fit" approach can be used. With this approach, each pin can be flat (e.g., with a square or rectangular cross-section) and include a hole (or eye) stamped through the pin, like an eye of a needle used for sewing. A pin used with this approach is an example of what is more generally referred to herein as a compliant pin, and is able to be compressed when inserted into a hole to form a secure connection. More specifically, a cross-sectional diameter of each pin is larger than the cross-sectional diameter of its corresponding hole to provide an interference or press-fit when the pin is inserted into the hole. The compressed pin applies pressure against inner electrically conductive surfaces of the holes to provide a secure mechanical and electrical connection.

Compliant pin dimensions have been increasingly scaled down. Miniaturization of compliant pins creates manufacturing difficulties due to tolerance issues. Imperfections in the shape of a pin (e.g., asymmetry) due to these tolerance issues can result in too much unwanted deformation of a compliant pin when the pin is inserted into a hole (e.g., in a circuit board), causing reduced normal force between the pin and the barrel of a hole into which the pin is inserted. Thus, the retention force of the pin in its hole is degraded, and performance of a product including the compliant pins decreases. For example, known compliant pins may exhibit unwanted plastic deformation and not enough elastic deformation. Plastic deformation refers to a type of irreversible deformation, which occurs in materials after stresses have attained a certain threshold value, such as the elastic limit or yield stress. Elastic deformation refers to a type of reversible deformation. With elastic deformation, once forces (e.g., a stress field) are no longer applied, the object returns to its original shape. On the other hand, an irreversible deformation (e.g., plastic deformation) remains even after stresses have been removed.

Non-symmetrical shapes of pins can also cause a concentration of deformation and crack formation in critical zones of compliant pins having eye of the needle type openings when the pins are inserted into a hole. For example, a pin having an eye of the needle type opening may exhibit increased strain at a particular interval of stress to result in a crack, where strain is defined as the amount of deformation an object experiences compared to its original size and shape, and stress is defined as a force per unit area, such as tensile or compressive loading on an object. Reliability issues can occur in electronic interconnects including cracked pins.

Accordingly, there is a need for an improved compliant pin design that produces more reliable interconnects when using a compliant pin.

SUMMARY

Embodiments of the present invention provide a compliant pin, an electrical assembly including the compliant pin and method of manufacturing the compliant pin.

For example, in one embodiment, a compliant pin comprises a base portion at a proximal end of the compliant pin, a tip portion at a distal end of the compliant pin, and a medial portion between the base portion and the tip portion. The medial portion includes a first arm and a second arm. The tip portion includes first and second extensions extending from the first and second arms, respectively, with the first and second extensions defining a slit therebetween.

In another embodiment, an electrical assembly comprises a first connecting part including a plurality of compliant pins, and a second connecting part including a plurality of holes to respectively receive the compliant pins. Each compliant pin of the electrical assembly has the above-described configuration.

In yet another embodiment, a method of manufacturing the above-described compliant pin comprises specifying a configuration of a medial portion, specifying a configuration of a tip portion, and stamping a plurality of compliant pins in accordance with the specified configurations.

Advantageously, illustrative embodiments allow a contact area of the pin in a hole to safely deform with less plastic deformation and more elastic deformation than in conventional designs, and reduce asymmetry and other adverse effects of imperfections in the shape of the compliant pin that may have occurred during, for example, manufacturing of the pin. Embodiments of the present invention are applicable to pins with reduced dimension scale, such as, for example, pins that can be inserted and used in holes 0.5 mm in diameter or less.

These and other features and advantages of the present invention will become more readily apparent from the accompanying drawings and the following detailed description.

DETAILED DESCRIPTION

Embodiments of the present invention will be described herein with reference to exemplary compliant pins and associated electrical assemblies and manufacturing methods. It is to be appreciated, however, that embodiments of the invention are not necessarily restricted to the particular illustrative compliant pins, electrical assemblies and manufacturing methods shown.

Embodiments of the present invention create a new approach in compliant pin design, which decreases plastic deformation with respect to conventional designs when a pin is inserted into an opening, such as, for example, a hole in a PCB or printed circuit card. Embodiments of the present invention include a pin having an innovative shape, which includes a slit forming an opening at a distal end of the pin. The distal end is a part of the pin at a leading end thereof that is first to contact a hole when the pin is inserted into a hole. A compliant pin, in accordance with an embodiment of the present invention, has a contact area that, when the pin is inserted in a hole, can safely deform with more elastic deformation than in conventional designs, and reduces adverse effects of imperfections in the shape (e.g., asymmetry) of the compliant pin that may have occurred during, for example, manufacturing of the pin. Embodiments of the present invention are applicable to pins with reduced dimension scale, such as, for example, pins that can be inserted and used in holes 0.5 mm in diameter or less, although such dimensions and others referred to herein should not be viewed as requirement of the invention.

Figure 1B:
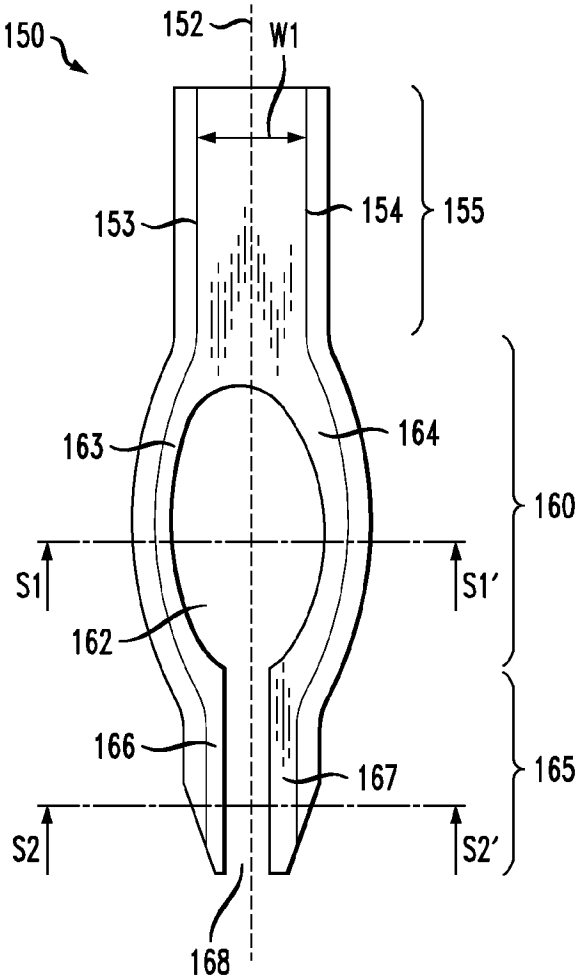
FIG. 1B illustrates a compliant pin having a non-symmetrical shape, in accordance with an embodiment of the present invention.
Figure 1A:
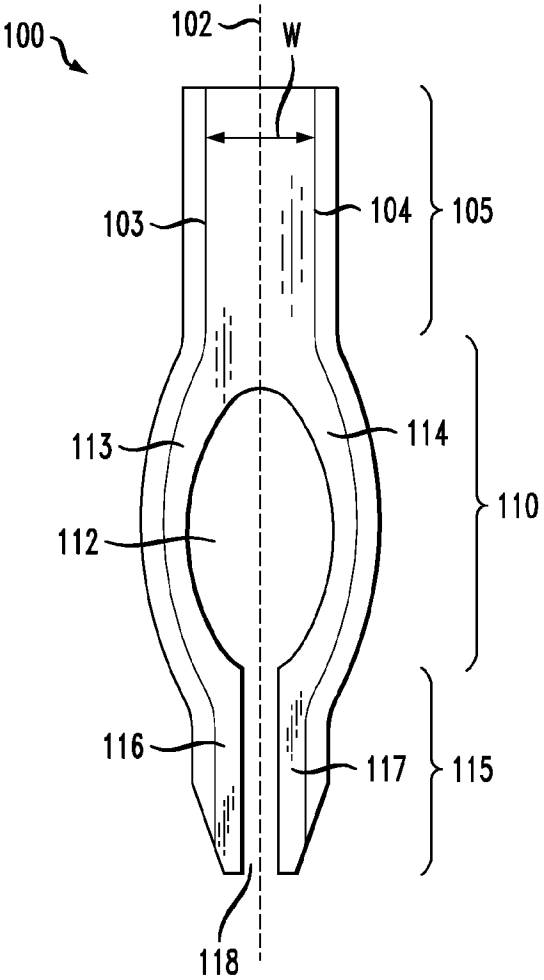
FIG. 1A illustrates a compliant pin having a symmetrical shape, in accordance with an embodiment of the invention.

FIG. 1A illustrates a compliant pin, in accordance with an embodiment of the invention, wherein the compliant pin 100 has a symmetrical shape. The compliant pin 100 is symmetrical about a primary axis, which is central axis 102. FIG. 1B also illustrates a compliant pin, in accordance with an embodiment of the present invention, wherein the complaint pin 150 has a non-symmetrical shape due to, for example, tolerance limitations of stamping processes for the production of compliant pins. For example, in the case of the production of compliant pins for a hole size of 0.5 mm diameter and less, a resulting shape of a pin may be non-symmetrical. The compliant pin 150 is not symmetrical about a central axis 152.

As can be seen in FIG. 1A, which is a front view of a pin, in accordance with an embodiment of the present invention, the pin 100 includes a base portion 105, a medial portion 110, and a tip portion 115. The base portion 105 is at a proximal end of the compliant pin 100 and includes opposite side walls 103 and 104 that define a width W of the base portion 105 therebetween. The pin 100 extends a length outwardly from the base portion 105 to a tip portion 115. The medial portion 110 of the pin 100 extends from the base portion 105, and the tip portion 115 of the pin 100 extends from the medial portion 110. The medial portion 110 curves convexly outward at a left arm 113 and a right arm 114 to form an oval or approximately oval shape. The left and right arms 113, 114 are positioned opposite each other, and are spaced apart from each other to define an open center area 112 of the medial portion 110, which is open with a through-hole. The tip portion 115 is at a distal end of the compliant pin 100, extends from its medial portion 110 and includes a left extension 116 and right extension 117 defining a slit 118 therebetween. The left and right extensions 116, 117 extend from corresponding left and right arms 113, 114 of the medial portion 110. The left and right extensions 116, 117 have substantially planar surfaces facing each other, and are positioned opposite and spaced apart from each other to define the slit 118, which extends from the center area 112. The substantially planar surfaces are substantially parallel to each other.

As can be seen in FIG. 1B, which is a front view of a pin, in accordance with an embodiment of the present invention, the pin 150 includes a base portion 155, a medial portion 160, and a tip portion 165. The base portion 155 is at a proximal end of the compliant pin 150 and includes opposite side walls 153 and 154 that define a width W1 of the base portion 155 therebetween. The pin 150 extends a length outwardly from the base portion 155 to a tip portion 165. The medial portion 160 of the pin 150 extends from the base portion 155, and the tip portion 165 of the pin 150 extends from the medial portion 160. The medial portion 160 curves convexly outward at a left arm 163 and a right arm 164 to form an oval or approximately oval shape. The left and right arms 163, 164 are positioned opposite each other, and are spaced apart from each other to define an open center area 162 of the medial portion 160, which is open with a through-hole. The tip portion 165 is at a distal end of the compliant pin 150, extends from its medial portion 160 and includes a left extension 166 and right extension 167 defining a slit 168 therebetween. The left and right extensions 166, 167 extend from corresponding left and right arms 163, 164 of the medial portion 160. The left and right extensions 166, 167 have substantially planar surfaces facing each other, and are positioned opposite and spaced apart from each other to define the slit 168, which extends from the center area 162. The substantially planar surfaces are substantially parallel to each other.

Referring to FIG. 1B, a left arm 163 of the medial portion 160 has a smaller cross-sectional area than a right arm 164 of the medial portion 160, wherein the cross-sectional area is taken on a plane perpendicular to axis 152 (e.g., cross-section along line S1-S1'). A left extension 166 of the tip portion 165 has a smaller cross-sectional area than a right extension 167 of the tip portion 165, wherein the cross-sectional area is taken on a plane perpendicular to axis 152 (e.g., cross-section along line S2-S2'). The smaller cross-sectional areas of left arm 163 and left extension 166 result in a non-symmetrical shape with respect to the central axis 152 running through a center of the pin 150. As explained above, the asymmetrical shape can be due to tolerance limitations of stamping processes for the production of compliant pins that cause imperfections in a manufactured pin. In another scenario, the asymmetry may occur when the right arms and extensions 164 and 167 have smaller cross-sectional areas than the left arms and extensions 163 and 166.

Figure 2:
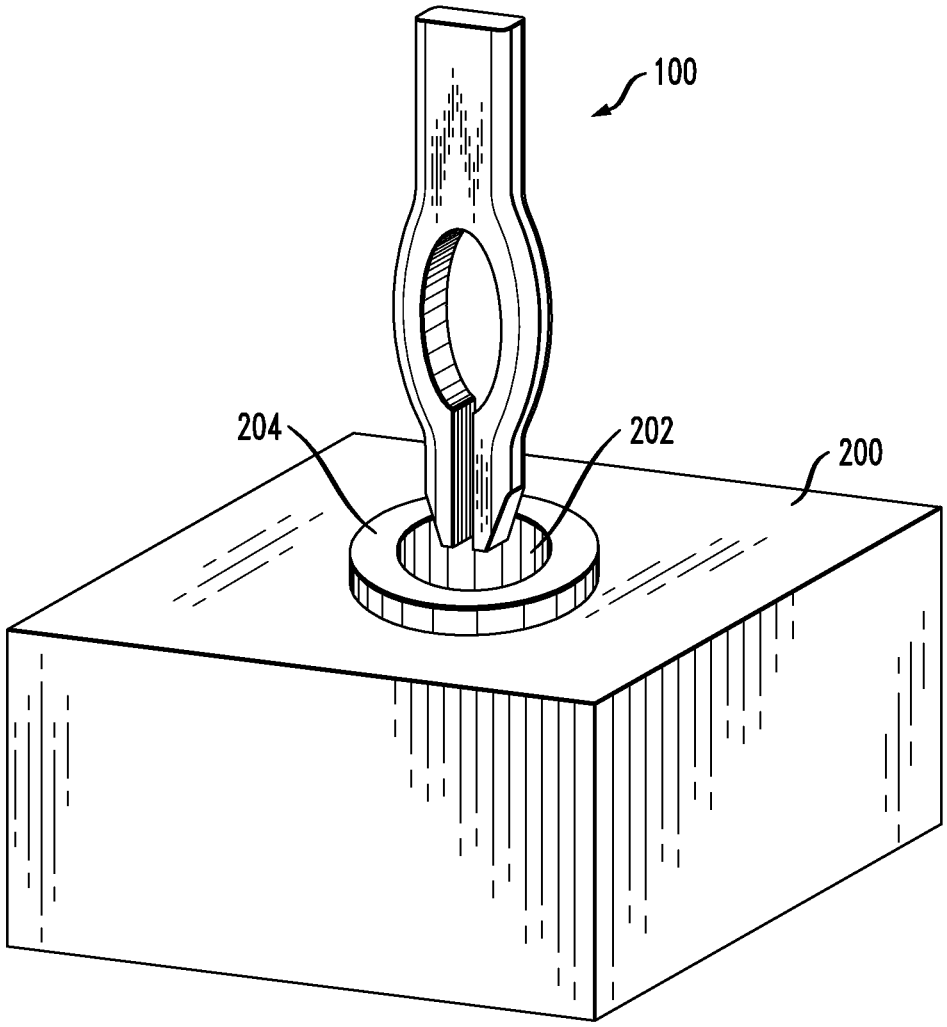
FIG. 2 illustrates a compliant pin prior to insertion into a hole of a circuit board, in accordance with an embodiment of the present invention.
Figure 3B:
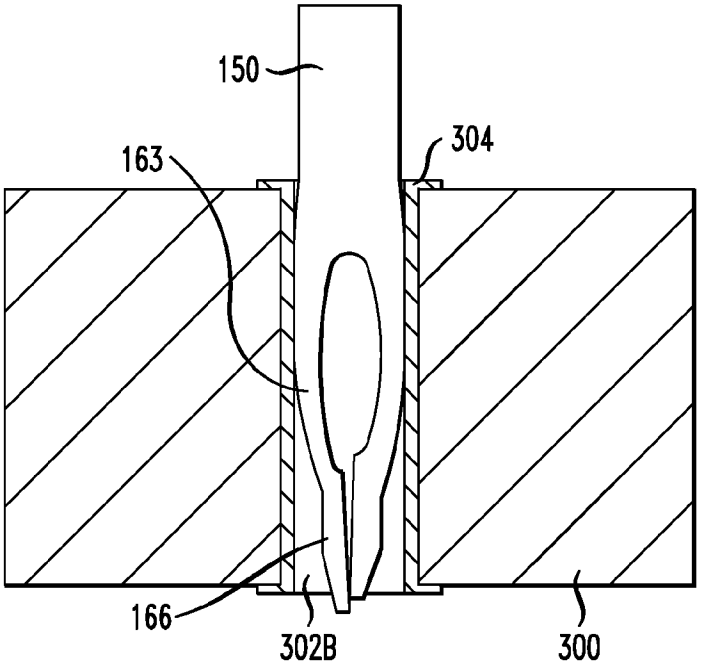
FIGS. 3A and 3B illustrate compliant pins inserted into a hole of a circuit board, in accordance with embodiments of the present invention.
Figure 3A:
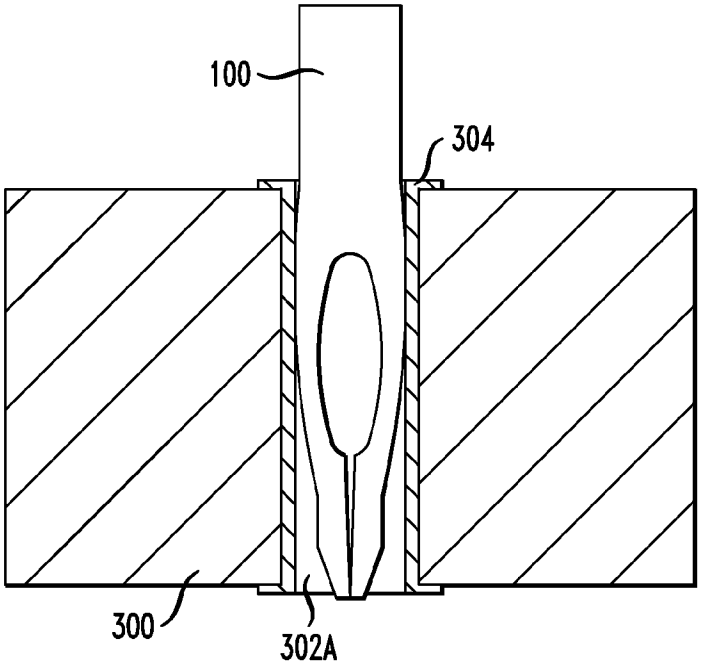

Referring to FIG. 2, a pin 100 is shown prior to insertion into a hole 202 of a PCB 200. FIGS. 3A-3B illustrate pins 100 and 150, respectively, inserted into holes 302A and 302B of a PCB 300. In accordance with an embodiment of the present invention, the holes 202, 302A and 302B are plated through holes (PTHs) and are plated with a conductive material 204, 304, such as, for example, a conductive metal or alloy including, for example, copper, bronze, silver, aluminum, gold, tin and/or tungsten. A thickness of conductive plating of a PTH can be in a range of 0.001" to 0.0025". The pins 100, 150 are press-fit pins having flexible arms 113, 114, 163, and 164 and flexible extensions 116, 117, 166 and 167, and the PTH remains rigid. In accordance with an embodiment of the present invention, the press-fit joint is a permanent connection and generates both electrical and mechanical connections. The pins, like the PTHs, also include a conductive material.

Referring to FIGS. 3A and 3B, when the pins 100, 150 are received within their corresponding PTHs 302A, 302B of a PCB 300, the tip portion 115, 165 and the medial portion 110, 160 extend within the PTH 302A, 302B, while the base portion 105, 155 extends outside the PTH 302A, 302B. In some embodiments, part of the base portion 105, 155 may extend within the PTH 302A, 302B or part of the medial portion 110, 160 may extend outside the PTH 302A, 302B. As a pin 100, 150 is received within the corresponding PTH 302A, 302B, the arms 113, 114, 163, 164 engage the electrically conductive material 304 on the inner wall of the PTH 302A, 302B and are deflected inwardly toward each other. Engagement between the arms 113, 114, 163 and 164 and the electrically conductive material 304 electrically connects the pin 100, 150 to the PTH 302A, 302B.

As can be understood from FIGS. 3A and 3B, insertion of a compliant pin 100, 150 into a PTH 302A, 302B of a PCB 300 produces elastic and plastic deformation of the compliant pin structure. If the pin is not symmetrical, as in the case of pin 150, areas of the structure with smaller cross-sectional areas (e.g., arm and extension 163 and 166) deform more than areas of the structure with larger cross-sectional areas. For example, the left and right extensions 166, 167 of the tip portion are positioned in an original position opposite each other in an un-inserted state of the compliant pin 150, and, in an inserted state of the compliant pin 150 into a hole 302B, the extensions 166, 167 are offset from each other due to the extension 166 having increased deformation in a longitudinal (length) direction of the pin 150. The left and right arms 163, 164 of the medial portion 160 are also positioned in an original position opposite each other in an un-inserted state of the compliant pin 150, and, in an inserted state of the compliant pin 150 into a hole 302B, the arms 163, 164 are offset from each other due to the arm 163 having increased deformation in the longitudinal direction of the pin 150.

Figure 4A:
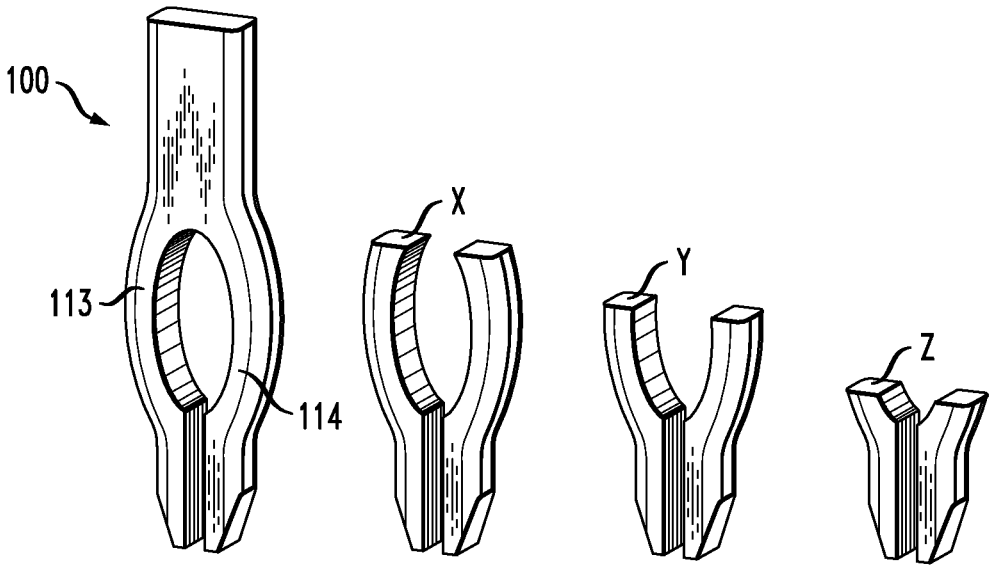
FIGS. 4A and 4B are perspective views illustrating geometrical aspects of a compliant pin, in accordance with an embodiment of the present invention.
Figure 4B:
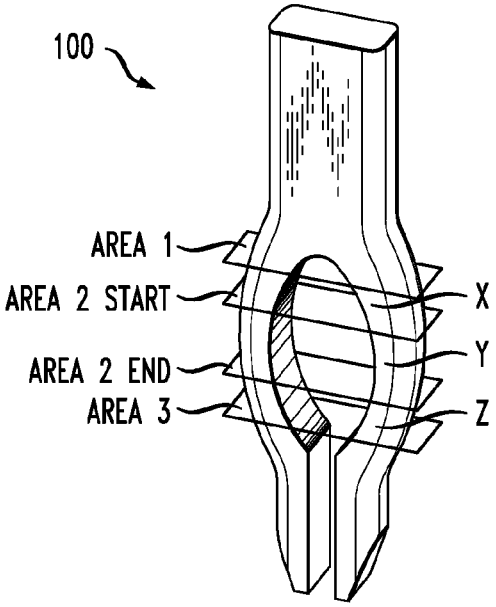
Figure 4C:
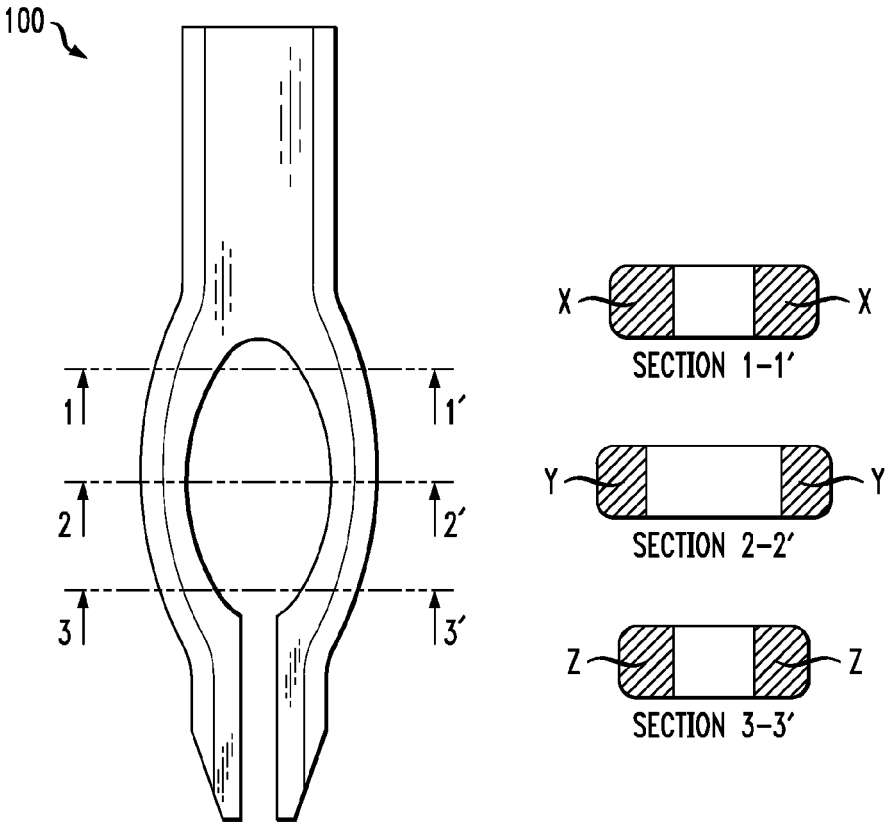
FIG. 4C includes front and cross-sectional views illustrating geometrical aspects of a compliant pin, in accordance with an embodiment of the present invention.

The presence of the slit 118, 168, which separates left and right extensions 116, 117, 166 and 167 of the pins 100, 150, allows the pins to freely deform elastically without risk of cracking or breaking due to increased freedom of movement along the length of the pins. The design of the pins 100, 150 including the slits 118, 168 eliminates stress concentration areas at the top and bottom of an eye structure, and, if necessary, permits non-symmetric deformation. In a non-limiting example, FIG. 3B illustrates more elastic deformation in the areas of the structure with smaller cross-sectional areas (e.g., arm and extension 163 and 166). The pin 150 remains usable due to the presence of the slit 168 which permits safe deformation within a predetermined range. Referring to FIGS. 4A-4C, in order to achieve the desired range of elastic deformation in a pin's structure, an embodiment of the present invention is configured such that the cross-sectional areas A1, A2 and A3 of parts X, Y and Z of arms 113, 114, 163 and 164 have the following relationship: $A2<A1$, $A2<A3$, where cross-sectional area A1 and cross-sectional area A3 are equal or approximately equal to each other. While pin 100 is shown in FIGS. 4A-4C, the cross-sectional area relationships of parts X, Y and Z also apply to pin 150. As can be seen from FIG. 4C, the cross-sectional areas of parts X and Z are equal to each other, and the cross-sectional area of part Y is less than that of parts X and Z. In addition, according to an embodiment, $A2 \leq 0.8*A1$ and/or $A2 \leq 0.8*A3$. It is to be appreciated that these cross-sectional area relationships are just exemplary, and numerous alternative relationships of cross-sectional areas may be used in other embodiments.

Referring to FIG. 4B, the part X having cross-sectional area A1 is adjacent the base portion, the part Z having cross-sectional area A3 is adjacent the tip portion, and the part Y having cross-sectional area A2 is between the parts X and Z. More particularly, parts X and Z are positioned near the center of the top and bottom radii of the center area 112, 162. Part Y, which is between parts X and Z, is subjected to more elastic deformation than parts X and Z. The cross-sectional areas A1, A2 and A3 are taken on respective planes perpendicular to a primary axis (e.g., central axis 102, 152) of the compliant pin. The planes corresponding to the cross-sectional areas A1, A2 and A3 are ordered in a direction from the base portion towards the tip portion, such that the plane corresponding to the cross-sectional area A1 is closer to the proximal end of the compliant pin than the planes corresponding to cross-sectional areas A2 and A3, the plane corresponding to the cross-sectional area A3 is closer to the distal end of the compliant pin than the planes corresponding to cross-sectional areas A1 and A2, and the plane corresponding to the cross-sectional area A2 is between the planes corresponding to the cross-sectional areas A1 and A3.

Figure 5:
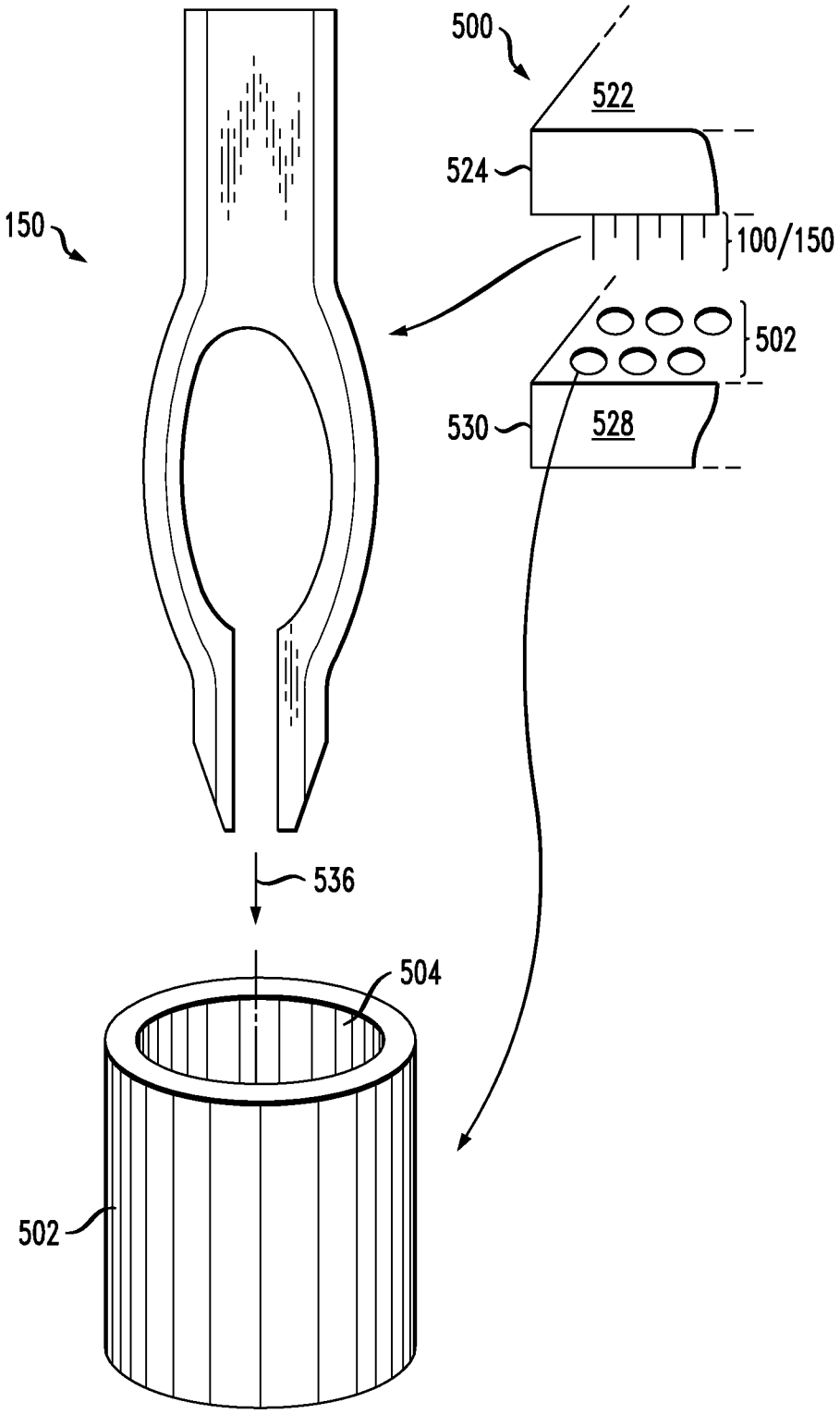
FIG. 5 is a perspective view illustrating an electrical assembly in an embodiment of the present invention.

FIG. 5 is a perspective view illustrating an electrical assembly 500 in which embodiments of the present invention can be used. The electrical assembly 500 includes a first connecting part 522 including at least a housing 524 and pins 100/150 in accordance with embodiments of the present invention. The electrical assembly 500 further includes a second connecting part 528 including at least a housing 530 and a plurality of holes 502 to receive the pins 100/150. The holes 502 can be, for example metal-plated vias (e.g., PTHs) supported by the housing 530. In a non-limiting embodiment, the first connecting part 522 can be a connector of an electronic device, such as, for example, a computer hardware component, and the second connecting part 528 can be an electronic component such as a PCB. FIG. 5 further shows an expanded perspective view of a hole 502 and a pin 150, which is capable of being used as one of the pins of the first connecting part 522. The pin 150 inserts within a cavity 504 defined by the hole 502, along a central axis 536 of the hole 502.

Figure 6:
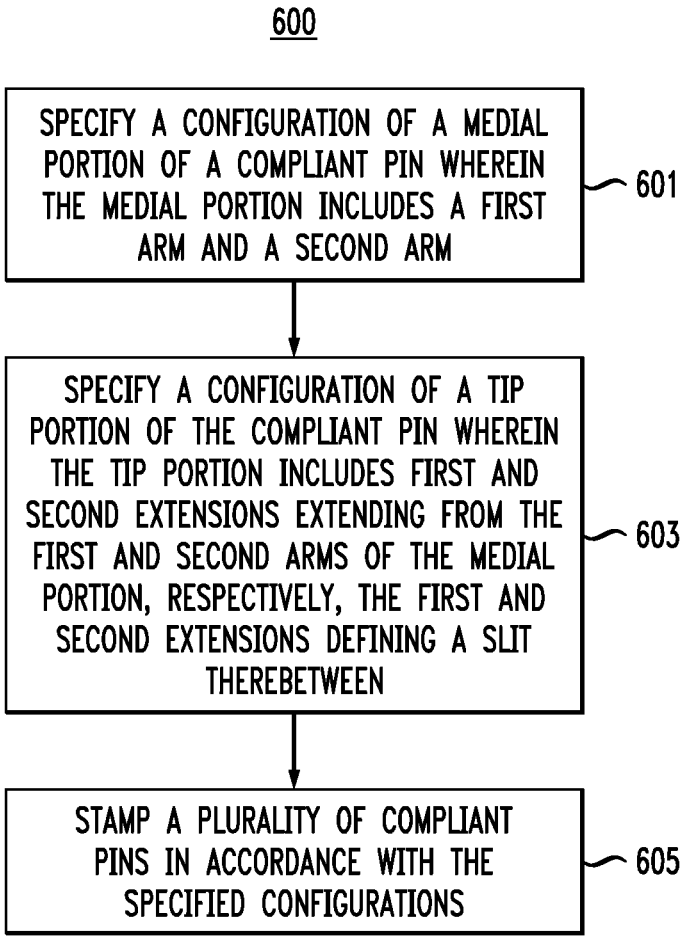
FIG. 6 is a flow diagram illustrating a method of manufacturing a compliant pin, in accordance with an embodiment of the present invention.

Referring to FIG. 6, a method 600 of manufacturing a compliant pin is shown, wherein the compliant pin comprises a body including a base portion 105, 155 at a proximal end of the compliant pin 100, 150, a tip portion 115, 165 at a distal end of the compliant pin 100, 150, and a medial portion 110, 160 between the base portion and the tip portion. Referring back to FIGS. 1A and 1B, the tip portion 115, 165 includes a slit 118, 168 between a first extension 116, 166 and a second extension 117, 167 of the tip portion.

At block 601, a configuration of the medial portion 110, 160 is specified, wherein the medial portion includes a first arm 113, 163 and a second arm 114, 164. The method may further include specifying that each of the first and second arms of the medial portion has cross-sectional areas A1, A2 and A3, respectively, taken on respective planes perpendicular to a primary axis of the compliant pin. In accordance with an embodiment of the present invention, the planes corresponding to the cross-sectional areas A1, A2 and A3 are ordered in a direction from the base portion towards the tip portion, such that the plane corresponding to the cross-sectional area A1 is closer to the proximal end of the compliant pin than the planes corresponding to cross-sectional areas A2 and A3, the plane corresponding to the cross-sectional area A3 is closer to the distal end of the compliant pin than the planes corresponding to cross-sectional areas A1 and A2, and the plane corresponding to the cross-sectional area A2 is between the planes corresponding to the cross-sectional areas A1 and A3. The cross-sectional areas A1, A2 and A3 can have the following relationship: A2<A1, A2<A3.

At block 603, a configuration of the tip portion 115, 165 is specified, wherein the tip portion includes a left extension 116, 166 and a right extension 117, 167 extending from a left arm 113, 163 and a right arm 114, 164, respectively, the left and right extensions defining a slit 118, 168 therebetween.

The method also includes, at block 605, stamping a plurality of compliant pins in accordance with the specified configurations using, for example, a bandolier process. The pins can be precision stamped from flat metal stock. In accordance with an embodiment of the present invention, bandoliering is employed when using progressive dies. Starting material may be attached to a single or double bandolier at certain spacing, which permits the mass production of compliant pins using die stamping by carrying the pins through a die automatically for processing. A stamping dye can provide dimensions with tolerances of ±0.025 mm.

The method may further include specifying a dimensional tolerance of the compliant pin such that at least the tip portion 115, 165 and at least part of the medial portion 110, 160 are capable of being inserted into a hole, for example, a PTH in a PCB, having a diameter of 0.5 mm or less.

Figure 7A:
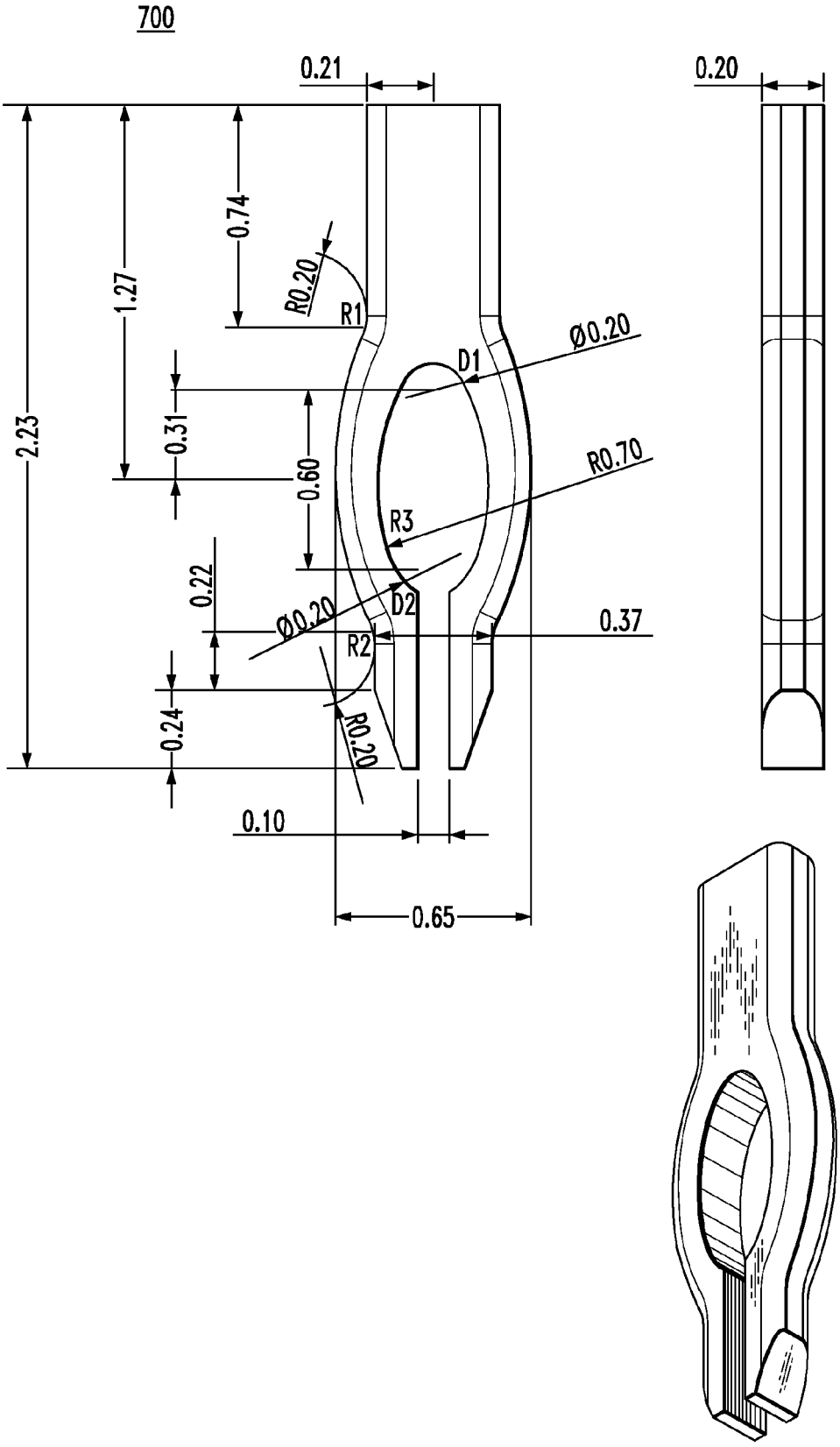
FIG. 7A includes front, side and perspective views of a compliant pin, in accordance with an embodiment of the present invention.
Figure 7B:
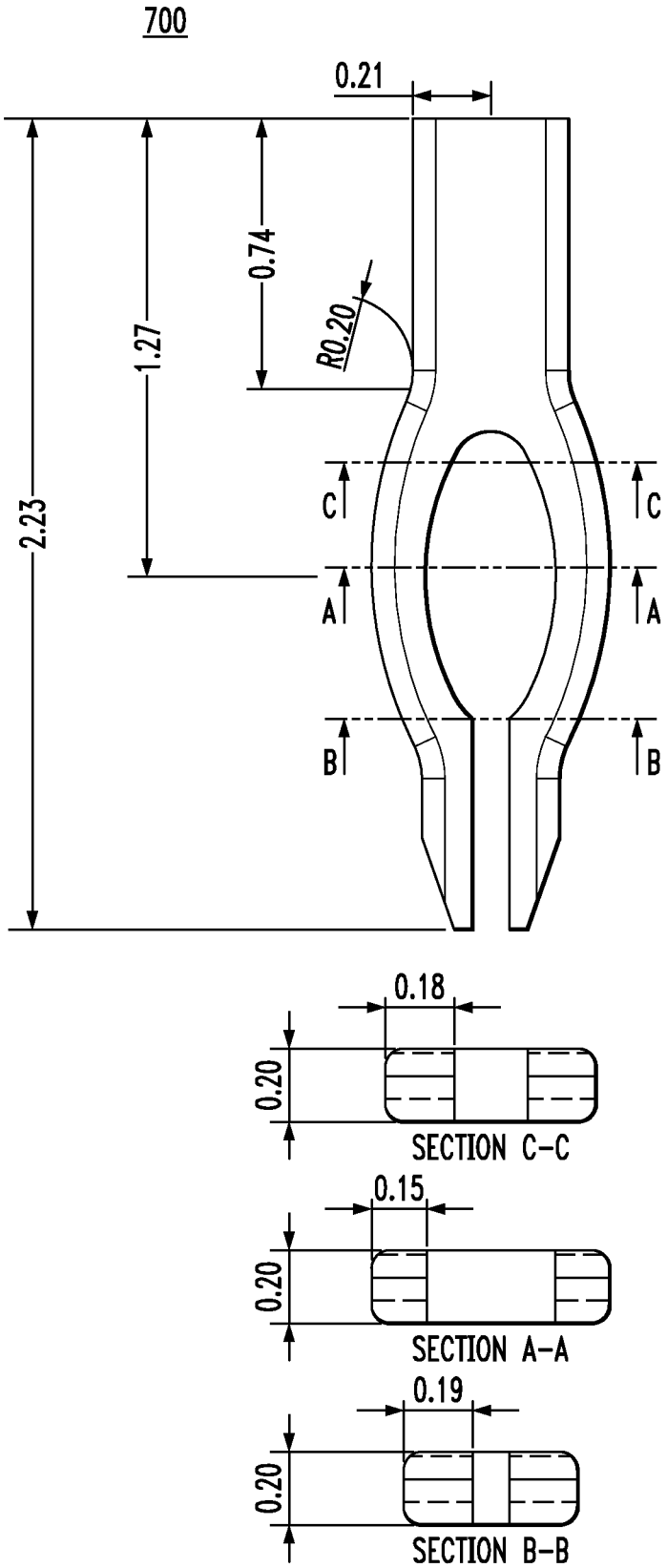
FIG. 7B includes front and cross-sectional views of a compliant pin, in accordance with an embodiment of the present invention.

Referring to FIGS. 7A and 7B, in a non-limiting illustrative embodiment, a compliant pin 700, and dimensions and areas thereof are shown. It is to be appreciated that compliant pin 700, and the dimensions and areas thereof are exemplary, and numerous alternative dimensions and areas may be used in other embodiments. The dimensions indicated in FIGS. 7A and 7B are in millimeters, and indicate an overall length of the compliant pin from a proximal end to a distal end of 2.23 mm, a length and width of a base portion of 0.74 mm and 0.42 mm (0.21*2), respectively, and a medial portion having a width at its largest point of 0.65 mm. The dimensions further indicate a flat outer edge of an extension of a tip portion having a length of 0.22 mm, and a length of 0.24 mm corresponding to an outer inclined edge of the extension of the tip portion. Other indicated dimensions include lengths of 1.27 mm, 0.31 mm and 0.60 mm, radii of 0.20 mm of curves forming edges at points R1 and R2, diameters of 0.20 mm at points D1 and D2, and a radius of 0.70 mm at point R3. A distance between opposing inner planar surfaces of extensions of a tip portion defining a slit therebetween is 0.10 mm, and a distance between outer edges of the extensions is 0.37 mm. A thickness of 0.20 mm is indicated in a right side view of the compliant pin 700.

The dimensions also include cross-sectional areas $S_A$ (Section A-A), $S_B$ (Section B-B) and $S_C$ (Section C-C) of 0.030 $mm^2$, 0.038 $mm^2$ and 0.036 $mm^2$, respectively. In this example, $S_A$=0.79SB and $S_A$=0.83$S_C$. $S_C$, $S_A$ and $S_B$ respectively correspond to areas A1, A2 and A3 discussed hereinabove.

It should again be emphasized that the above-described embodiments of the invention are presented for purposes of illustration only. Many variations may be made in the particular arrangements shown. For example, the particular arrangements of the compliant pins as shown in FIGS. 1A, 1B, 7A and 7B may be varied in alternative embodiments. Also, the cross-sectional area relationships described above may be varied in other embodiments. These and numerous other alternative embodiments within the scope of the following claims will be readily apparent to those skilled in the art.

What is claimed is:

1. A compliant pin comprising:

a base portion at a proximal end of the compliant pin;

a tip portion at a distal end of the compliant pin; and a medial portion between the base portion and the tip portion;

wherein the medial portion includes a first arm and a second arm;

wherein the tip portion includes first and second extensions extending from the first and second arms, respectively, the first and second extensions defining a slit therebetween;

wherein each of the first and second arms of the medial portion has cross-sectional areas A1, A2 and A3, respectively, taken on respective planes perpendicular to a primary axis of the compliant pin, the primary axis dividing each of the base, tip and medial portions, the planes being ordered in a direction from the base portion towards the tip portion;

wherein the plane corresponding to the cross-sectional area A1 is closer to the proximal end of the compliant pin than the planes corresponding to cross-sectional areas A2 and A3 and is located at a proximal region of the medial portion which tapers away from the primary axis of the compliant pin;

wherein the plane corresponding to the cross-sectional area A3 is closer to the distal end of the compliant pin than the planes corresponding to cross-sectional areas A1 and A2 and is located at a distal region of the medial portion which tapers toward the primary axis;

wherein the plane corresponding to the cross-sectional area A2 is between the planes corresponding to the cross-sectional areas A1 and A3; and wherein the cross-sectional areas A1, A2 and A3 have the following relationship: A2<A1, A2<A3.

2. The compliant pin according to claim 1 wherein the cross-sectional areas A1 and A3 are equal or approximately equal to each other.

3. The compliant pin according to claim 1 wherein at least one of A2≤0.8*A1 and A2≤0.8*A3.

4. The compliant pin according to claim 1 wherein the first and second extensions have substantially planar surfaces facing each other and separated by the slit.

5. The compliant pin according to claim 1 wherein the compliant pin is non-symmetrical about the primary axis of the compliant pin.

6. The compliant pin according to claim 1 wherein the first and second extensions of the tip portion are positioned opposite and spaced apart from each other, and one of the first extension and the second extension has a smaller cross-sectional area than its opposing extension, wherein the cross-sectional areas are taken on a plane perpendicular to the primary axis of the compliant pin.

7. The compliant pin according to claim 1 wherein the first arm of the medial portion is positioned opposite the second arm, and one of the first arm and the second arm of the medial portion has a smaller cross-sectional area than its opposing arm, wherein the cross-sectional areas are taken on a plane perpendicular to the primary axis of the compliant pin.

8. The compliant pin according to claim 1 wherein the first and second extensions of the tip portion are positioned in an original position in an un-inserted state of the compliant pin, and wherein at least one of the first extension and the second extension of the tip portion is offset from the original position in an inserted state of the compliant pin, wherein the offset is due to a deformation of at least one of the first extension and the second extension in a longitudinal direction of the compliant pin.

9. The compliant pin according to claim 1 wherein the first and second arms of the medial portion are positioned in an original position in an un-inserted state of the compliant pin, and wherein at least one of the first arm and the second arm of the medial portion is offset from the original position in an inserted state of the compliant pin, wherein the offset is due to a deformation of at least one of the first arm and the second arm in a longitudinal direction of the compliant pin.

10. The complaint pin according to claim 1, wherein at least the tip portion and at least part of the medial portion are capable of being inserted into a hole having a diameter of 0.5 mm or less.

11. An electrical assembly comprising:

a first connecting part including a plurality of compliant pins; and a second connecting part including a plurality of holes to respectively receive the compliant pins;

wherein each compliant pin comprises:

a base portion at a proximal end of the compliant pin;

a tip portion at a distal end of the compliant pin; and a medial portion between the base portion and the tip portion;

wherein the medial portion includes a first arm and a second arm; and wherein the tip portion includes first and second extensions extending from the first and second arms, respectively, the first and second extensions defining a slit therebetween;

wherein each of the first and second arms of the medial portion has cross-sectional areas A1, A2 and A3, respectively, taken on respective planes perpendicular to a primary axis of the compliant pin, the primary axis dividing each of the base, tip and medial portions, the planes being ordered in a direction from the base portion towards the tip portion;

wherein the plane corresponding to the cross-sectional area A1 is closer to the proximal end of the compliant pin than the planes corresponding to cross-sectional areas A2 and A3 and is located at a proximal region of the medial portion which tapers away from the primary axis of the compliant pin;

wherein the plane corresponding to the cross-sectional area A3 is closer to the distal end of the compliant pin than the planes corresponding to cross-sectional areas A1 and A2 and is located at a distal region of the medial portion which tapers toward the primary axis;

wherein the plane corresponding to the cross-sectional area A2 is between the planes corresponding to the cross-sectional areas A1 and A3; and wherein the cross-sectional areas A1, A2 and A3 have the following relationship: $A2<A1$, $A2<A3$.

12. The electrical assembly according to claim 11 wherein the cross-sectional areas A1 and A3 are equal or approximately equal to each other.

13. The electrical assembly according to claim 11 wherein at least one of $A2 \leq 0.8*A1$ and $A2 \leq 0.8*A3$.

14. The electrical assembly according to claim 11 wherein the first and second extensions of the tip portion are positioned opposite and spaced apart from each other, and one of the first extension and the second extension has a smaller cross-sectional area than its opposing extension, wherein the cross-sectional areas are taken on a plane perpendicular to the primary axis of the compliant pin.

15. The electrical assembly according to claim 11 wherein the first arm of the medial portion is positioned opposite the second arm, and one of the first arm and the second arm of the medial portion has a smaller cross-sectional area than its opposing arm, wherein the cross-sectional areas are taken on a plane perpendicular to the primary axis of the compliant pin.

16. The electrical assembly according to claim 11 wherein the first and second extensions of the tip portion are positioned in an original position in an un-inserted state of the compliant pin, and wherein at least one of the first extension and the second extension is offset from the original position in an inserted state of the compliant pin into one hole of the plurality of holes in which the compliant pin is inserted, wherein the offset is due to a deformation of at least one of the first extension and the second extension in a longitudinal direction of the compliant pin.

17. The electrical assembly according to claim 11 wherein the first and second arms of the medial portion are positioned in an original position in an un-inserted state of the compliant pin, and wherein at least one of the first arm and the second arm of the medial portion is offset from the original position in an inserted state of the compliant pin into a hole of the plurality of holes, wherein the offset is due to a deformation of at least one of the first arm and the second arm in a longitudinal direction of the compliant pin.

18. A method of manufacturing a compliant pin, wherein:

the compliant pin comprises:

a base portion at a proximal end of the compliant pin;

a tip portion at a distal end of the compliant pin; and a medial portion between the base portion and the tip portion, wherein the tip portion is located at a distal end of the compliant pin; and the method comprises:

specifying a configuration of the medial portion;

wherein the medial portion includes a first arm and a second arm;

wherein each of the first and second arms of the medial portion has cross-sectional areas A1, A2 and A3, respectively, taken on respective planes perpendicular to a primary axis of the compliant pin, the primary axis dividing each of the base, tip and medial portions, the planes being ordered in a direction from the base portion towards the tip portion;

wherein the plane corresponding to the cross-sectional area A1 is closer to the proximal end of the compliant pin than the planes corresponding to cross-sectional areas A2 and A3 and is located at a proximal region of the medial portion which tapers away from the primary axis of the compliant pin;

wherein the plane corresponding to the cross-sectional area A3 is closer to the distal end of the compliant pin than the planes corresponding to cross-sectional areas A1 and A2 and is located at a distal region of the medial portion which tapers toward the primary axis;

wherein the plane corresponding to the cross-sectional area A2 is between the planes corresponding to the cross-sectional areas A1 and A3; and wherein the cross-sectional areas A1, A2 and A3 have the following relationship: $A2<A1$, $A2<A3$ specifying a configuration of the tip portion, wherein the tip portion includes first and second extensions extending from the first and second arms, respectively, the first and second extensions defining a slit therebetween; and stamping a plurality of compliant pins in accordance with the specified configurations.

19. The method according to claim 18 wherein specifying the configuration of the tip portion comprises configuring the first and second extensions of the tip portion to be positioned in an original position in an un-inserted state of the compliant pin, and configuring at least one of the first extension and the second extension of the tip portion to be offset from the original position in an inserted state of the compliant pin, wherein the offset is due to a deformation of at least one of the first extension and the second extension in a longitudinal direction of the compliant pin.

20. The method according to claim 18 wherein specifying the configuration of the medial portion comprises configuring the first and second arms of the medial portion to be positioned in an original position in an un-inserted state of the compliant pin, and configuring at least one of the first arm and the second arm of the medial portion to be offset from the original position in an inserted state of the compliant pin, wherein the offset is due to a deformation of at least one of the first arm and the second arm in a longitudinal direction of the compliant pin.

* * * * *